US005633982A

United States Patent [19]

Ganesan et al.

[11] Patent Number: 5,633,982

[45] Date of Patent: May 27, 1997

[54] REMOVAL OF SWIRL ARTIFACTS FROM CELP-BASED SPEECH CODERS

[75] Inventors: Kalyan Ganesan, Germantown, Md.; Ho Lee, San Diego, Calif.; Prabhat Gupta, Germantown, Md.

[73] Assignee: Hughes Electronics, Los Angeles, Calif.

[21] Appl. No.: 734,210

[22] Filed: Oct. 21, 1996

Related U.S. Application Data

[63] Continuation of Ser. No. 169,789, Dec. 20, 1993, abandoned.

[51] Int. Cl.[6] ..... G10L 9/00; G10L 5/06

[52] U.S. Cl. ..... 395/2.42; 395/2.28; 395/2.35; 395/2.17

[58] Field of Search ..... 395/2.35, 2.28, 395/2.42, 2.14, 2.15, 2.17, 2.36, 2.37, 2.32, 2.26, 2.27, 2.24

[56] References Cited

U.S. PATENT DOCUMENTS

| | | | |
|---|---|---|---|
| 5,214,708 | 5/1993 | McEahern | 381/48 |
| 5,276,765 | 1/1994 | Freeman et al. | 395/2.42 |
| 5,307,405 | 4/1994 | Sih | 379/40 |
| 5,410,632 | 4/1995 | Hong et al. | 395/2.42 |
| 5,426,719 | 6/1995 | Franks et al. | 395/2.42 |
| 5,459,814 | 10/1995 | Gupta et al. | 395/2.42 |

FOREIGN PATENT DOCUMENTS

| | | | |
|---|---|---|---|
| 0532255A2 | 9/1992 | European Pat. Off. | G10L 5/00 |
| 9573398 | 5/1993 | European Pat. Off. | G10L 9/14 |
| 0573216A2 | 5/1993 | European Pat. Off. | G10L 9/14 |

OTHER PUBLICATIONS

IEEE Transactions on Speech and audio Processing; McCree et al., "A new mixed excitation LPC vocoder", pp. 593–596; May 1991.

*Primary Examiner*—Allen R. MacDonald
*Assistant Examiner*—Richemond Dorvil
*Attorney, Agent, or Firm*—John Whelan; Wanda Denson-Low

[57] ABSTRACT

The perception of speech processed by a CELP based coder, such as a VSELP coder, when operating in noisy background conditions is improved by removing swirl artifacts during silence periods. This is done by removing the low frequency components of the input signal when no speech is detected. A speech activity detector distinguishes between a periodic signal, like speech, and a non-periodic signal, like noise by using most of the VSELP coder internal parameters to determine the speech or non-speech conditions. To prevent the VSELP coder from determining pitches for non-periodic signals, a high pass filter is applied to the input signal to remove the pitch information for which the VSELP coder searches.

15 Claims, 4 Drawing Sheets

REMOVAL OF SWIRL ARTIFACTS FROM CELP-BASED SPEECH CODERS

This application is a continuation of application Ser. No. 08/169,789 filed on Dec. 20, 1993, now abandoned.

DESCRIPTION

BACKGROUND OF THE INVENTION

1. Field of the Invention

The present invention generally relates to digital voice communications and, more particularly, to the removal of swirl artifacts from code excited linear prediction (CELP) based coders, such as vector-sum excited linear predictive (VSELP) coders, when operating in background noise consisting of low or medium levels of non-periodic signals.

2. Description of the Prior Art

Cellular telecommunications systems in North America are evolving from their current analog frequency modulated (FM) form towards digital systems. Digital systems must encode speech for transmission and then, at the receiver, synthesizing speech from the received encoded transmission. For the system to be commercially acceptable, the synthesized speech must not only be intelligible, it should be as close to the original speech as possible.

Codebook Excited Linear Prediction (CELP) is a technique for speech encoding. The basic technique consists of searching a codebook of randomly distributed excitation vectors for that vector which produces an output sequence (when filtered through pitch and linear predictive coding (LPC) short-term synthesis filters) that is closest to the input sequence. To accomplish this task, all of the candidate excitation vectors in the codebook must be filtered with both the pitch and LPC synthesis filters to produce a candidate output sequence that can then be compared to the input sequence. This makes CELP a very computationally-intensive algorithm, with typical codebooks consisting of 1024 entries, each 40 samples long. In addition, a perceptual error weighting filter is usually employed, which adds to the computational load.

A number of techniques have been considered to mitigate the computational load of CELP encoders. Fast digital signal processors have helped to implement very complex algorithms, such as CELP, in real-time. Another strategy is a variation of the CELP algorithm called Vector-Sum Excited Linear Predictive Coding (VSELP). An IS54 standard that uses a full rate 8.0 Kbps VSELP speech coder, convolutional coding for error protection, differential quadrature phase shift keying (QPSK) modulation, and a time division, multiple access (TDMA) scheme has been adopted by the Telecommunication Industry Association (TIA). See *IS*54 *Revision A,* Document Number EIA/TIA PN2398.

The current VSELP codebook search method is disclosed in U.S. Pat. No. 4,817,157 by Gerson. Gerson addresses the problem of extremely high computational complexity for exhaustive codebook searching. The Gerson technique is based on the recursive updating of the VSELP criterion function using a Gray code ordered set of vector sum code vectors. The optimal code vector is obtained by exhasutively searching through the set of Gray code ordered code vector set. The Electronic Industries Association (EIA) published in August 1991 the *EIA/TIA Interim Standard PN*2759 for the dual-mode mobile station, base station cellular telephone system compatibility standard. This standard incorporates the Gerson VSELP codebook search method.

The CELP based coders, which use LPC coefficients to model input speech, work well for clean signals; however, when background noise is present in the input signal, the coders do a poor job of modelling the signal. This results in some artifacts at the receiver after decoding. These artifacts, referred to a swirl artifacts, considerably degrade the perceived quality of the transmitted speech.

SUMMARY OF THE INVENTION

It is therefore an object of the present invention to provide an improvement in the perception of speech processed by a CELP based coder, such as a VSELP coder, when operating in noisy background conditions by removing the swirl artifacts during silence periods.

According to the invention, the low frequency components of the input signal are removed when no speech is detected, thus removing the swirl artifacts during silence periods. This results in a better perception of the speech at the receiver. The invention uses a voice activity detector (VAD) which distinguishes between a periodic signal, like speech, and a non-periodic signal, like noise. This VAD uses most of the VSELP coder internal parameters to determine the speech or non-speech conditions. More particularly, the VSELP coder tends to determine pitch information from a non-periodic input signal even though the actual input signal does not have any periodicity. This determination of pitch from a no speech signal is what generates the swirly signal artifact in the reproduced signal at the receiver. To prevent the VSELP coder from determining pitches for non-periodic signals, a high pass filter is applied to the input signal to remove the pitch information for which the VSELP coder searches. Removing pitch information allows only the code search process that generates the speech frame information. Alternatively, the VSELP coder can be made to declare a no pitch condition and continue processing without pitch information.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
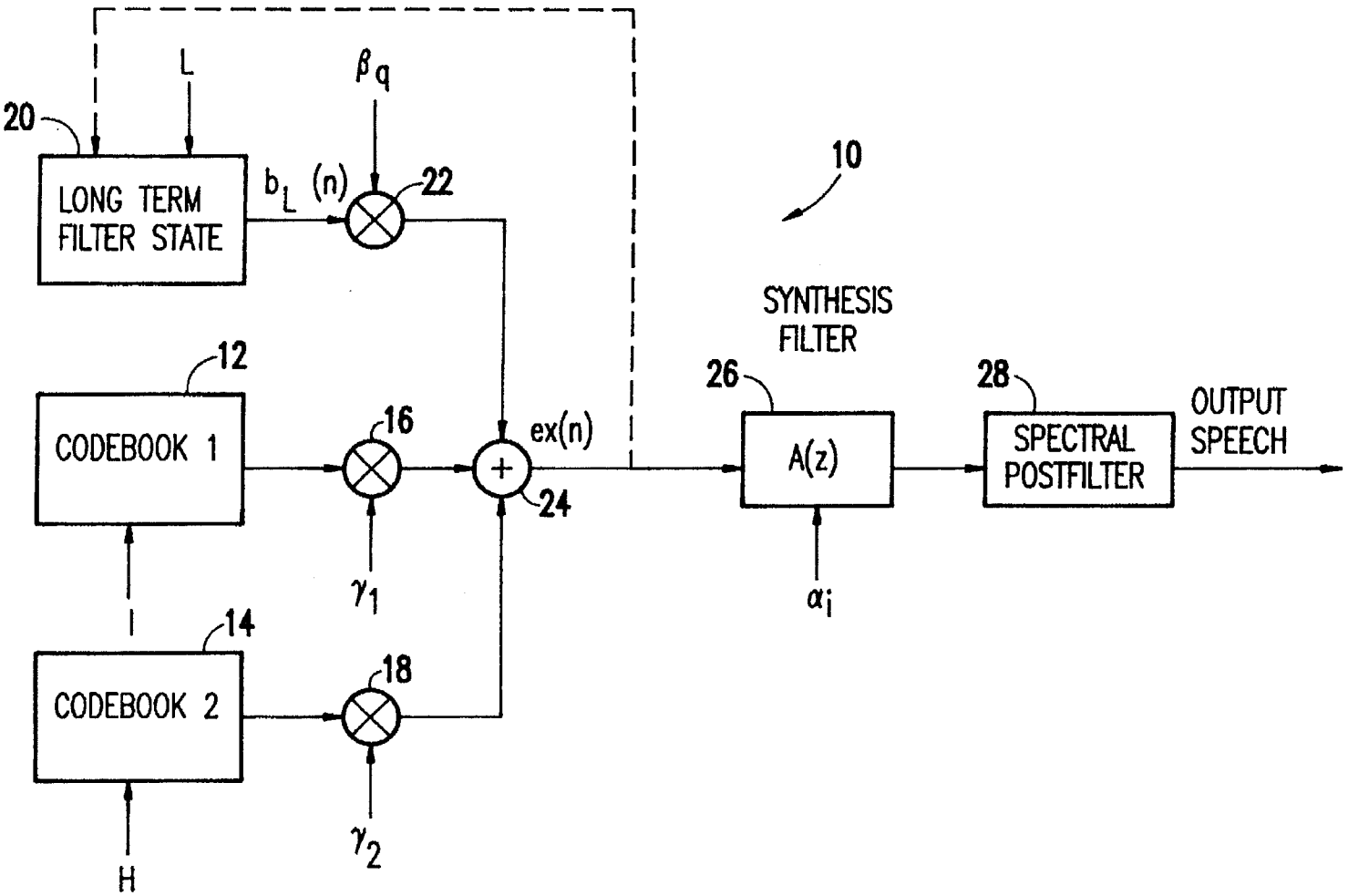
FIG. 1 is a block diagram of a speech decoder utilizing two VSELP excitation codebooks.

Referring now to the drawings, and more particularly to FIG. 1, there is shown a block diagram of the speech decoder 10 utilizing two VSELP excitation codebooks 12 and 14 as set out in the *EIA/TIA Interim Standard,* cited above. Each of these code books is typically implemented in read only memory (ROM) containing M basis vectors of length N, where M is the number of bits in the codeword and N is the number of samples in the vector. Codebook 12 receives an input code I and provides an output vector. Codebook 14 receives an input code H and provides an output vector. Each of these vectors is scaled by corresponding gain terms $\gamma_1$ and $\gamma_2$, respectively, in multipliers 16 and 18. In addition, long term filter state memory 20, typically in the form of a random access memory (RAM), receives an input lag code, L, and provides an output, $b_L(n)$, representing the long term filter state. This too is scaled by a gain term $\beta$ in multiplier 22. The outputs from the three multipliers 16, 18 and 22 are combined by summer 24 to form an excitation signal, ex(n). This combined excitation signal is fed back to update the long term filter state memory 20, as indicated by the dotted line. The excitation signal is also applied to the linear predictive code (LPC) synthesis filter 26, represented by the z-transform $$\frac{1}{A(z)}.$$

The transfer function of the synthesis filter 26 is time variant controlled by the short-term filter coefficients $\alpha_i$. After reconstructing the speech signal with the synthesis filter 26, and adaptive spectral postfilter 28 is applied to enhance the quality of the reconstructed speech. The adaptive spectral postfilter is the final processing step in the speech decoder, and the digital output speech signal is input to a digital-to-analog (D/A) converter (not shown) to generate the analog signal which is amplified and reproduced by a speaker.

The following are the basic parameters for the 7950 bps speech coder and decoder as specified by the *EIA/TIA Interim Standard:*

| | sampling rate | 8 kHz |
|---|---|---|
| $N_F$ | frame length | 160 samples |
| N | subframe length | 40 samples |
| $M_1$ | # bits codeword I | 7 |
| $M_2$ | # bits codeword H | 7 |
| $\alpha_i$ | short-term filter coefficients | 38 bits/frame |
| I, H | codewords | 7 + 7 bits/subframe |
| $\beta$, $\gamma_1$, $\gamma_2$ | gains | 8 bits/subframe |
| L | lag | 7 bits/subframe |

Figure 2:
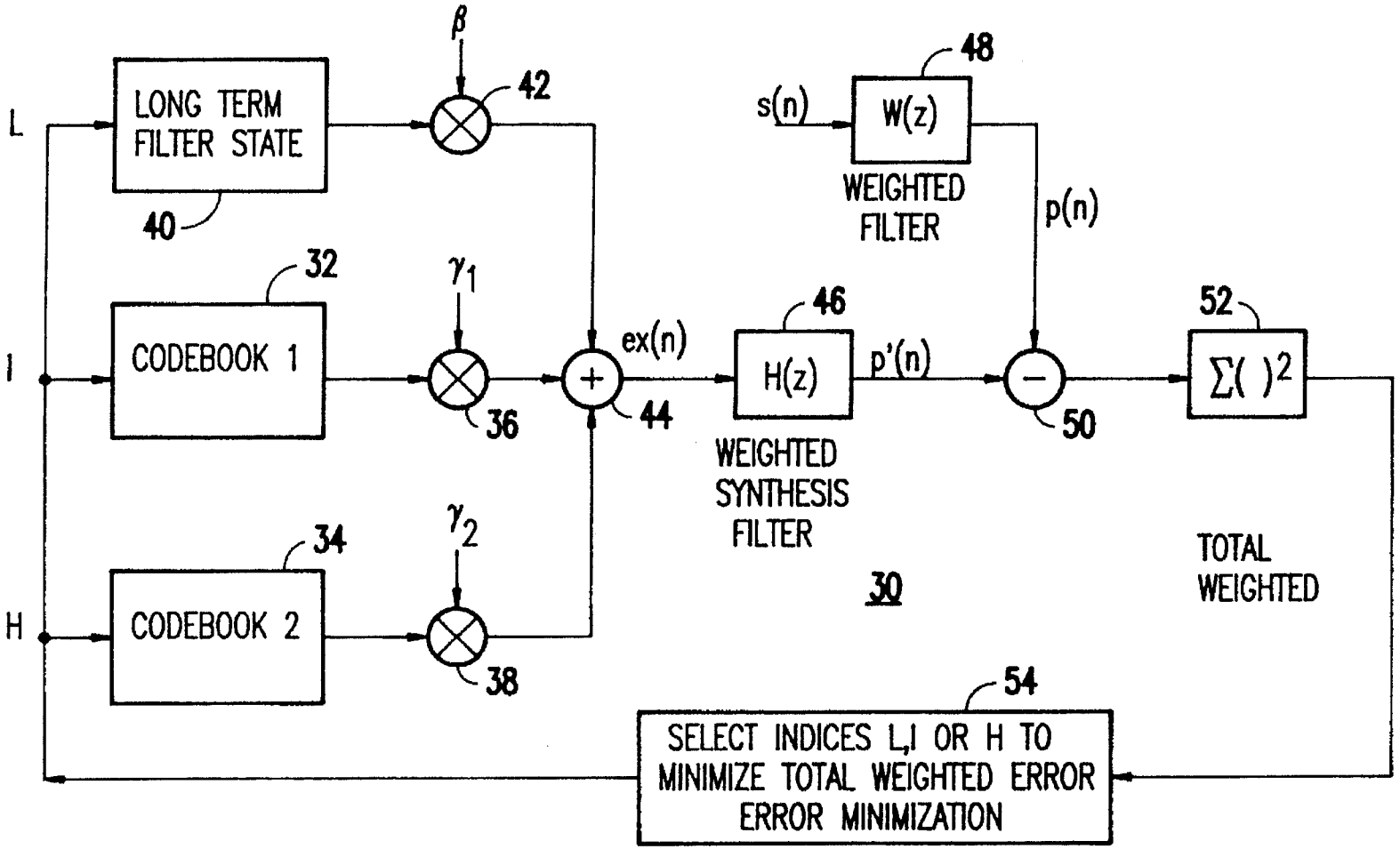
FIG. 2 is a block diagram of a speech synthesizer using two VSELP excitation codebooks and a long term filter state of past excitation.

FIG. 2 is a block diagram of the encoder 30 for generating the codewords I and H, the lag L, and the gains $\beta$, $\gamma_1$ and $\gamma_2$, which are transmitted to the decoder shown in FIG. 1. The encoder includes two VSELP excitation codebooks 32 and 34, similar to the codebooks 12 and 14. Codebook 32 receives an input code I and provides an output vector. Codebook 34 receives an input code H and provides an output vector. Each of these vectors is scaled by corresponding gain terms $\gamma_1$ and $\gamma_2$, respectively, in multipliers 36 and 38. In addition, long term filter state memory 40 receives an input lag code, L, and provides an output, $b_L(n)$, representing the long term filter state. This too is scaled by a gain term $\beta$ in multiplier 42. The outputs from the three multipliers 36, 38 and 42 are combined by summer 44 to form an excitation signal, ex(n). This combined excitation signal is applied to the weighted synthesis filter 46, represented by the z-transform H(z). This is an all pole filter and is the bandwidth expanded synthesis filter $$\frac{1}{A(\gamma^{-1}z)}.$$

The output of the synthesis filter 46 is the vector p'(n). The sampled speech signal s(n) is input to a weighting filter 48, having a transfer function represented by the z-transform W(z), to generate the weighted speech vector p(n). p(n) is the weighted input speech for the subframe minus the zero input response of the weighted synthesis filter 46. The vector p'(n) is subtracted from the weighted speech vector p(n) in subtractor 50 to generate a difference signal e(n). The signal e(n) is subjected to a sum of squares analysis in block 52 to generate an output that is the total weighted error which is input to error minimization process 54. The error minimization process selects the lag L and the codewords I and H, sequentially (one at a time), to minimize the total weighted error.

Figure 3:
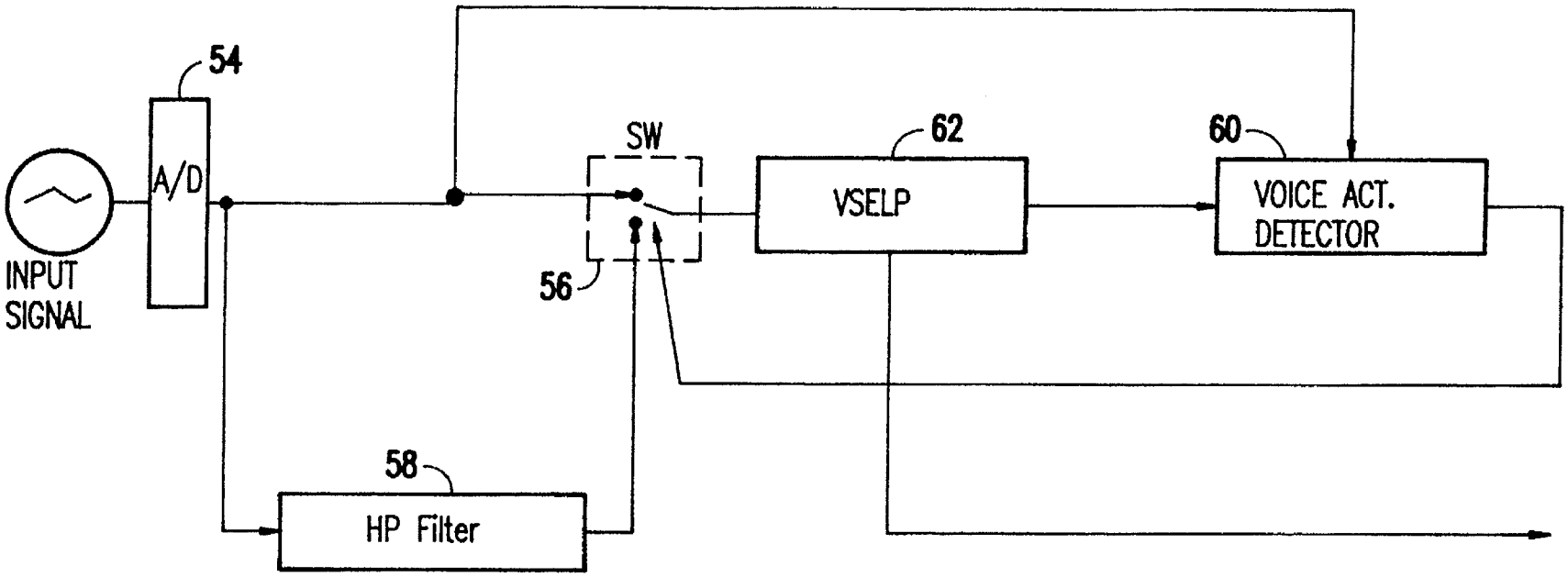
FIG. 3 is a block diagram of the circuitry used to remove swirl artifacts from the VSELP coder.

The improvement to the basic VSELP coder is shown in FIG. 3, to which reference is now made. The input signal is digitized by an analog-to-digital (A/D) converter 54 and supplied to one pole of a switch 56. The digitized input signal is also supplied via a high pass filter 58 to a second pole of the switch 56. The switch 56 is controlled to select either the digitized input signal or the high pass filtered output from filter 58 by a voice activity detector (VAD) 60. The output of the switch 56 is supplied to the VSELP coder 62. The VAD 60 receives as inputs the original digitized input signal and an output of the VSELP coder 62. It will be understood that once the analog input signal is sampled by the A/D converter 54, typically at an 8 kHz sampling rate, all processing represented by the remaining blocks of the block diagram of FIG. 3 is performed by a digital signal processor (DSP), such as the TMS320C5x single chip DSP.

Figure 4:
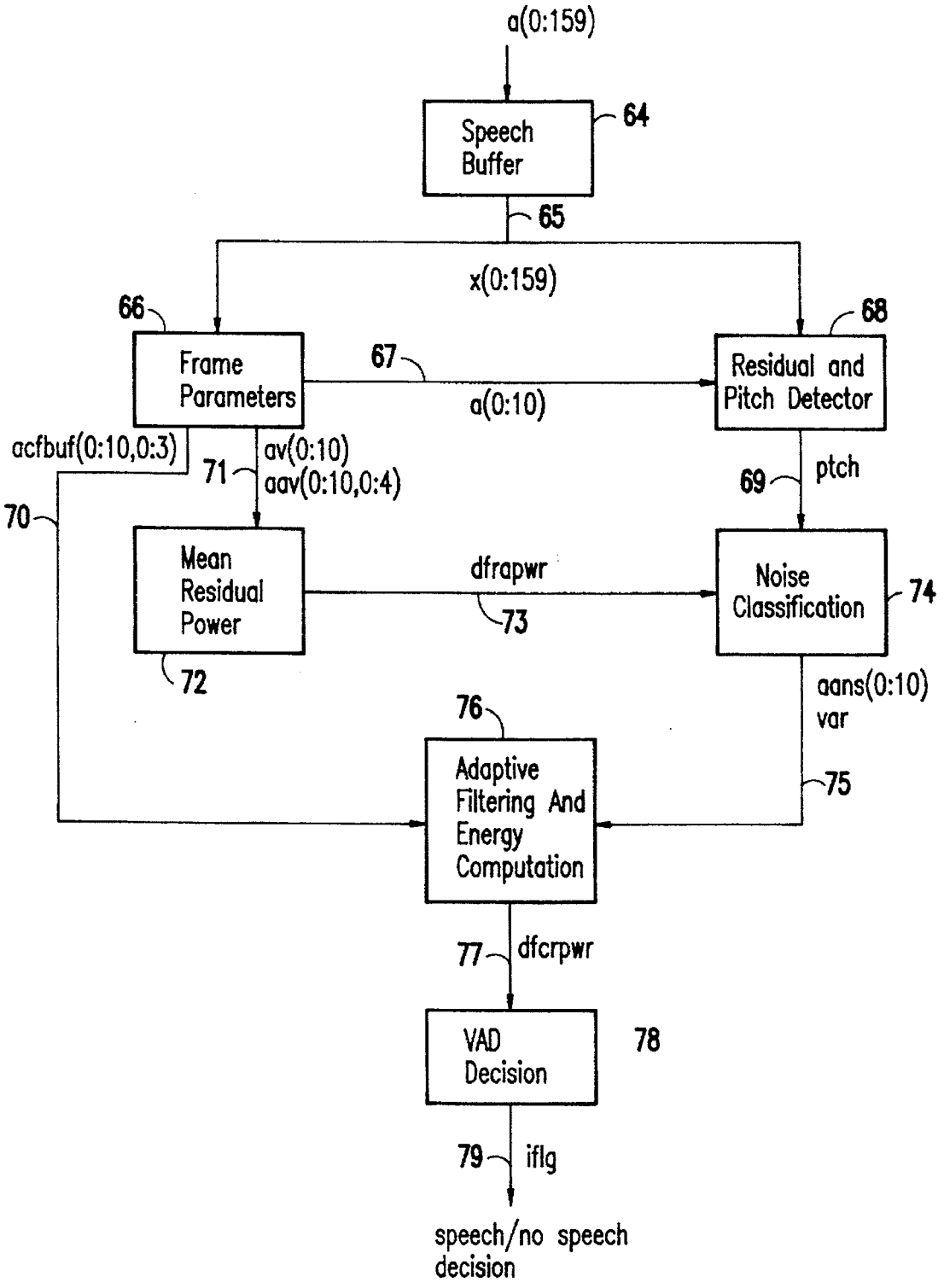
FIG. 4 is a block diagram showing the architecture of the voice activity detection process.

As described above, the VSELP coder 62 determines pitch and input signal transfer function (i.e., reflection coefficients). The VAD 60 uses the reflection coefficients generated by the VSELP coder 62 and the input signal in order to generate a decision of speech (i.e., a TRUE output) or no speech (i.e., a FALSE output). The TRUE output causes the switch 56 to select the digitized input signal from the A/D converter 54, but a FALSE output causes the switch 56 to select the high pass filtered output from high pass filter 58. More particularly, the VAD 60 uses the reflection coefficients from the VSELP coder 62 in determining current frame LPC coefficients, and these LPC coefficients and previously determined LPC coefficient histories are averaged and stored in a buffer. The original 160 input samples are 500 Hz highpass filtered and used in determining the auto-correlation function (ACF), and this ACF and previously determined ACFs are stored in a buffer. This data is used by the VAD 60 to determine whether speech is present or not. The architecture of this detection process is shown in FIG. 4, to which reference is now made.

The input digitized speech is input to a speech buffer 64 which, in a preferred embodiment, stores 160 samples of speech. The speech samples 65 from the speech buffer 64 are supplied to the frame parameters function 66 and to the residual and pitch detector function 68. The frame parameters function 66 uses the VSELP reflection coefficients in determining current frame LPC coefficients 67 to the pitch detector function 68, and the pitch detector function 68 outputs a Boolean variable 69 which is true when pitch is detected over a speech frame. Existence of a periodic signal is determined in pitch detector function 68. The frame parameters function 66 also provides an output 70 which is the current and last three flames of the auto-correlation functions (ACF) and an output 71 which is five sets of LPC coefficients based on the average ACF functions. The output 71 is supplied to the mean residual power function 72 which, in turn, generates an output 73 representing the current residual power. This output 73 is input to the noise classification function 74, as is the Boolean variable 69. The noise classification function 74 generates as its output the noise LPC coefficients 75 which, together with the output 70 from the frame parameters function 66, is input to the adaptive filtering and energy computation function 76, the output of which is the current residual power 77. The VAD decision function 78 generates the speech/no speech decision output 79.

Thus, it will be appreciated that the VAD 60 is basically an energy detector. The energy of the filtered signal is compared with a threshold, and speech is detected whenever the threshold is detected. A FALSE output of the VAD 60 causes the input to the VSELP coder 62 to be from the high pass filter 58, thereby removing the low frequency (i.e., pitch) components of the input signal and thus removing the swirl artifacts that would otherwise be generated by the VSELP coder 62 during silence periods.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A system for combatting the effect of swirl artifacts created by low frequency components of an input signal in a code excited linear prediction (CELP) based encoder comprising:

a switch connected to receive an input signal, the input signal containing periodic and non-periodic signals;

a high pass filter also connected to receive the input signal and operable to remove low frequency components likely to cause the production of swirl artifacts from the input signal, the switch being controllable to selectively supply the input signal or an output of the high pass filter to the CELP based encoder; and a detector connected to receive the input signal and information from the CELP based encoder and generate an output indicating the presence of periodic signals in the input signal, the detector controlling the switch to connect the input signal to the CELP based encoder when periodic signals are detected and to connect the output of the high pass filter to the CELP based encoder when non-periodic signals are detected;

wherein low frequency components likely to cause the production of swirl artifacts are alternately filtered from the CELP based encoder input signal to thereby prevent the production of swirl artifacts.

2. The system of claim 1 wherein the CELP based encoder is a vector-sum excited linear predictive (VSELP) speech encoder.

3. The system of claim 1 wherein the detector receives reflection coefficients from the CELP based encoder and determines an energy level of the input signal in order to make a determination of the presence of periodic signals in the input signal.

4. The system of claim 3 wherein the detector uses linear predictive code coefficients and auto correlation functions received over time.

5. The system of claim 4 wherein the detector comprises a buffer for storing linear predictive coefficients and auto correlation functions over time for a current frame of digital values of the input signal and an averaging circuit for averaging current and previous linear predictive coefficients for the current frame as well as current and previous auto correlation functions for the current frame for determining the presence of periodic or non-periodic signals.

6. The system of claim 1 wherein the periodic signals are speech-like and the non-periodic signals are noise-like and wherein the detector is a voice activity detector (VAD).

7. The system of claim 1 wherein the low frequency components removed by the high pass filter correspond to pitch information.

8. The system of claim 1 further comprising a control gate connected to the detector and the CELP based encoder for instructing the CELP based encoder to encode filtered input signals without pitch information when non-periodic signals are detected and to encode input signals with pitch information when periodic signals are detected.

9. A method for combatting the effects of swirl artifacts created by low frequency components of an input signal to a code excited linear prediction (CELP) based speech encoder comprising the steps of:

sampling an input signal and converting input signal samples to digital values, the input signal containing periodic and non-periodic signals, high pass filtering the digital values of the input signal to remove low frequency components likely to cause the production of swirl artifacts from samples of the input signal, said low frequency components corresponding to pitch information;

determining the presence of periodic signals in the input signal by receiving the digital values of the input signal and information from the CELP based speech encoder; and selectively supplying the digital values of the input signal or high pass filtered digital values to the CELP based speech encoder, the digital values of the input signal being connected to the CELP based speech-encoder when periodic signals are detected and the high pass filtered digital values being connected to the CELP based speech encoder when non-periodic signals are detected.

10. The method of claim 9 further comprising:

selectively causing the CELP based speech encoder to declare a no pitch condition when noise-like signals are detected by the VAD, the CELP based speech encoder continuing to process digital values of the input signal without pitch information, but when speech-like signals are detected by the VAD, the CELP based speech encoder resuming processing of digital values of the input signal with pitch information.

11. The method of claim 9 wherein the CELP based speech encoder is a vector sum excited linear predictive (VSELP) speech encoder.

12. The method of claim 9 wherein the step of determining comprises receiving reflection coefficients from the CELP based speech encoder and determining an energy level of the input signal.

13. The method of claim 12 wherein the step of determining an energy level comprises using linear predictive code coefficients and auto correlation functions received over time.

14. The method of claim 13 wherein the step of using linear predictive coefficients and auto correlation functions comprises storing linear predictive coefficients and auto correlation function over time in a buffer and for a current frame of digital values of the input signal averaging current and previous linear predictive coefficients for the current frame as well as current and previous auto correlation functions for the current frame for determining the presence of periodic or non-periodic signals.

15. The method of claim 9 wherein the periodic signals represent speech and the non-periodic signals represent noise and the detector is a voice activity detector (VAD).

* * * * *